United States Patent [19]

Carlsson

[11] Patent Number: 4,530,643

[45] Date of Patent: Jul. 23, 1985

[54] CENTRIFUGAL PUMP IMPELLER

[75] Inventor: Valdemar Carlsson, Solna, Sweden

[73] Assignee: ITT Industries, Inc., New York, N.Y.

[21] Appl. No.: 532,126

[22] Filed: Sep. 14, 1983

[30] Foreign Application Priority Data

Oct. 11, 1982 [SE] Sweden ..... 8205775

[51] Int. Cl.[3] ..... F04D 29/66; F04D 29/38

[52] U.S. Cl. ..... 416/144; 416/19; 416/179; 415/213 R

[58] Field of Search ..... 416/179, 19, 144, 90 R, 416/232, 145, 91, 92, 186 R; 415/206, 213 B, 213 R, 106

[56] References Cited

U.S. PATENT DOCUMENTS

| | | | |
|---|---|---|---|
| 1,470,607 | 10/1923 | Hazell | 415/106 |
| 1,654,907 | 1/1928 | Wood | 415/213 R |
| 1,754,992 | 4/1930 | Fabrin | 415/213 R |
| 2,655,868 | 10/1953 | Lindau et al. | 415/213 R |
| 2,853,019 | 9/1958 | Thornton | 416/186 R |
| 2,935,245 | 5/1960 | McDonald | 416/92 |
| 3,414,188 | 12/1968 | Gallie | 415/106 |
| 3,485,484 | 12/1969 | Quinchon | 416/92 |

FOREIGN PATENT DOCUMENTS

| | | | |
|---|---|---|---|
| 2732863 | 1/1979 | Fed. Rep. of Germany | 415/213 B |
| 491020 | 2/1954 | Italy | 415/213 R |
| 189936 | 6/1937 | Switzerland | 415/206 |

*Primary Examiner*—Robert E. Garrett
*Assistant Examiner*—H. Edward Li
*Attorney, Agent, or Firm*—John T. O'Halloran; Robert P. Seitter; Mary C. Werner

[57] ABSTRACT

A pump impeller to be used when pumping liquid containing solid bodies. The impeller is provided with one single vane designed with a hollow for balancing the impeller. The hollow is connected to the surroundings via a slot at a point where the vane has its maximum diameter. The impeller is then perfectly balanced when rotating in liquid as well as in air.

2 Claims, 2 Drawing Figures

CENTRIFUGAL PUMP IMPELLER

BACKGROUND OF THE INVENTION

This invention concerns an impeller for centrifugal pumps meant for pumping liquids.

More precisely, the invention concerns an impeller of the so-called single vane type, which means that the impeller is provided with one single vane extending helically or along a screwline around the impeller a part of, one or several turns. The channel formed by the vane is axially limited by cover discs, which are parts of the impeller or the surrounding pump housing.

Pump impellers of the type referred to above are all used for pumping liquids containing solid bodies, for instance, sewage water. The advantage is that the risk for clogging decreases if one instead of several vanes are used. Sometimes a certain minimum throughlet in a pump impeller for sewage pumps is prescribed by law. This can only be fulfilled by single vane impellers if reasonable dimensions should be kept.

In order to further diminish the risks for clogging, it is sometimes preferable to design the vane with a varying thickness so that the channel formed by the vane and the cover discs has a relatively constant cross-section in the direction towards the outlet. (Swedish Patent Application No. 7903729-7)

A problem which occurs by these impellers is that they become unbalanced under certain conditions which causes vibrations in the pump unit. This may be eliminated by balancing weights in the impeller which means that the problem is solved when the pump operates under normal conditions, that is, submersed in liquid. If, however, the pump operates in air, the problem with vibrations remains and as those pumps sometimes operate during such varying conditions, the solution with balancing weights is not entirely satisfactory. Another problem which often occurs by single vanes is an extensive efficiency loss.

SUMMARY OF THE INVENTION

In order to solve the problems mentioned, the vane is formed with a hollow which has one single connection to the surroundings and which therefore will contain pumped medium when the pump operates, the connection between the hollow and the surroundings having the form of a slot extending along the entire height of the vane and adjacent its trailing edge where the vane has its maximum diameter.

BRIEF DESCRIPTION OF THE DRAWING

Above-mentioned and other features and objects of this invention will become more apparent by reference to the following description taken in conjunction with the accompanying drawing in which.

DESCRIPTION OF THE PREFERRED EMBODIMENT

Figure 1:
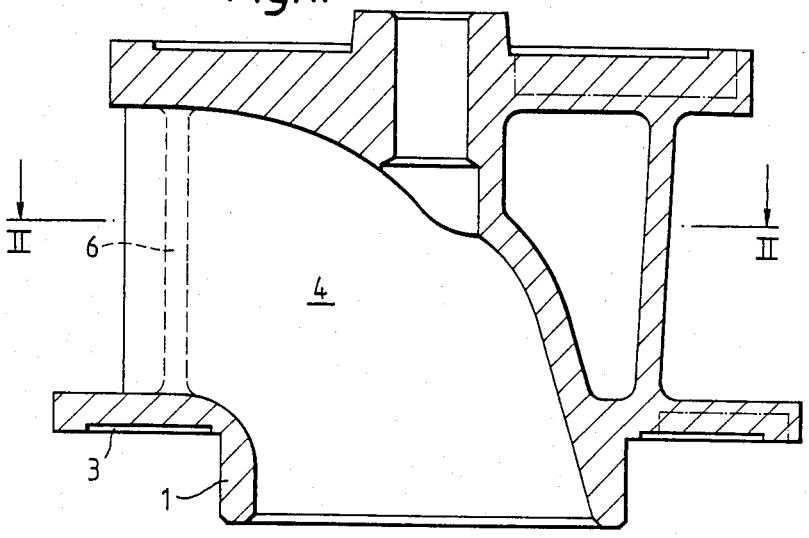
FIG. 1 is an axial sectional view of the impeller.
Figure 2:
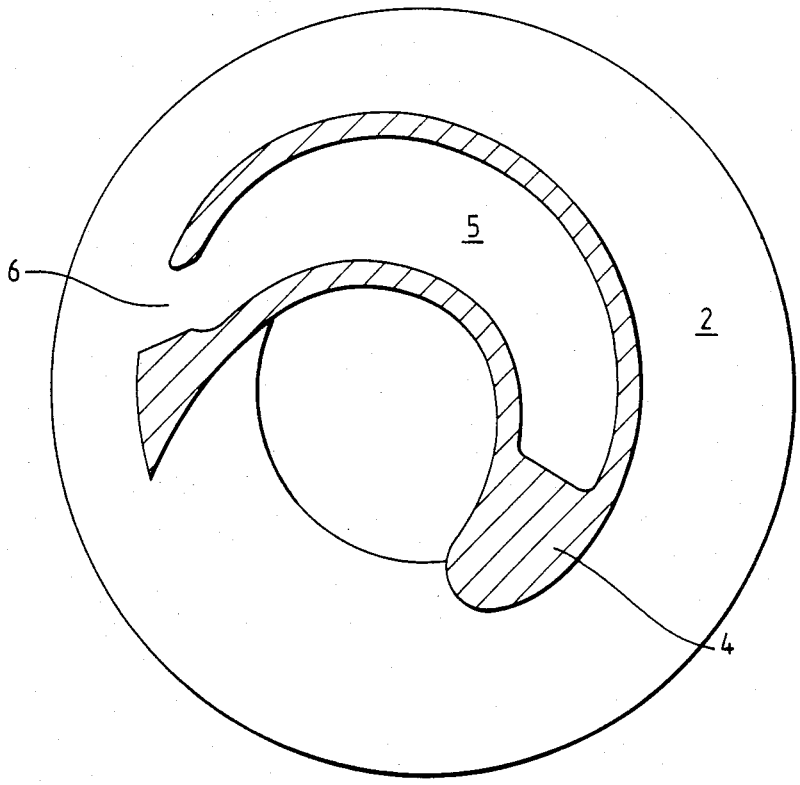
FIG. 2 is a cross-sectional view of the impeller of FIG. 1 taken on line II—II.

In the drawing a centrifugal pump impeller 1 has cover discs 2 and 3. The vane 4 is formed with a hollow 5 and a slot 6.

The vane 4 is thus formed with a hollow 5 the size of which is adapted according to calculations. The hollow has a connection to the surroundings via the slot 6, which is placed adjacent the trailing edge of the vane where the latter has its maximum diameter. The slot, the width of which depends on impeller diameter and number of revolutions during a given time, extends along the entire height of the impeller between the cover discs 2 and 3.

By the design and placing of the slot a vortex occurs in its entrance which keeps it free of pollution. It is here important that the slot ends at or near the point where the impeller has its maximum diameter.

By help of the slot an exchange of media between the hollow and the surroundings is made possible. This means that when the pump operates submersed in liquid, the hollow contains this liquid which contributes to the balancing of the impeller. When the pump operates in air, the liquid pours out, thus decreasing the mass of the vane and obtaining a suitable balancing for this condition.

It is important that there is only one connection, the slot 6, between the hollow and the surroundings, since otherwise there is a risk that pollution may accumulate in the hollow and its entrance.

The previously mentioned vortexes also contribute to the efficiency of the pump and it is also important that the slot is placed adjacent the maximum diameter of the impeller to obtain the best media exchange possible.

According to the invention, a centrifugal pump impeller has been obtained which, in addition to good conditions concerning clogging, also makes an operation without vibrations possible and obtains a very good efficiency.

While I have described above the principles of my invention in connection with specific apparatus, it is to be clearly understood that this description is made only by way of example and not as a limitation to the scope of my invention as set forth in the accompanying claims.

I claim:

1. A centrifugal pump impeller for pumping a fluid medium comprising:

an integral body including a vane being dimensioned such that the flow cross-section in the impeller is substantially constant, said vane having a leading edge and a trailing edge, an internal space for containing the fluid medium, and means for permitting exchange of the fluid medium between said internal space and the exterior of said vane to balance the impeller when the density of the fluid medium changes and for preventing accumulation in said internal space of pollutants which may become entrained in the fluid medium, said means including a slot extending adjacent said trailing edge and along the entire height of said vane constituting the sole communication between said internal space and the exterior of said vane.

2. The impeller as claimed in claim 1 wherein said trailing edge extends radially outwardly a greater distance than said leading edge.

* * * * *